United States Patent [19]

Bossecker

[11] Patent Number: 4,611,844

[45] Date of Patent: Sep. 16, 1986

[54] TILTING HARNESS FOR HANDLING HEAVY ROLLS

[75] Inventor: Walter Bossecker, Neustadt, Fed. Rep. of Germany

[73] Assignee: Industriewerk Nachf. Seifert & Co. KG, Neustadt, Fed. Rep. of Germany

[21] Appl. No.: 742,250

[22] Filed: Jun. 7, 1985

[30] Foreign Application Priority Data

Jun. 16, 1984 [DE] Fed. Rep. of Germany ..... 3422427

[51] Int. Cl.[4] ..... B66C 1/34; B66C 1/22

[52] U.S. Cl. ..... 294/86.41; 294/103.2

[58] Field of Search ..... 294/86.41, 103.2, 82.12, 294/93, 99, 102.1, 103.1, 104, 111, 112, 67.1; 414/779, 684, 783, 626, 728, 908, 911

[56] References Cited

U.S. PATENT DOCUMENTS

| | | | |
|---|---|---|---|
| 3,680,907 | 8/1972 | Siegwart | 294/86.41 |
| 4,166,647 | 9/1979 | Schmidt | 294/86.41 |
| 4,375,936 | 3/1983 | Dechantsreiter | 294/86.41 |

*Primary Examiner*—James B. Marbert

*Attorney, Agent, or Firm*—Jordan and Hamburg

[57] ABSTRACT

Tilting harness for receiving and for handling heavy spools or rolls with the help of a rolling frame guided in a crane carriage, and a mandrel arranged on the rolling frame, the mandrel serving to lock in the core bore of the roll with a radially extendable clamping jaw, whereby the drive for the operation of the clamping jaw comprises a spring-stressed tilting lever, which can be tilted by means of a cam against the force of the spring in the retracted position of the clamping jaw.

23 Claims, 10 Drawing Figures

TILTING HARNESS FOR HANDLING HEAVY ROLLS

The invention relates to a tilting harness for receiving and for handling heavy spools or rolls with the help of a rolling frame guided in a crane carriage, and a mandrel arranged on the rolling frame, the mandrel serving the purpose of locking in the core bore of the roll by means of a radially extendable clamping jaw.

Such tilting harnesses are usually suspended on a crane carriage and serve for transferring wound materials, such as wires, cables, sheet metal coils, paper webs, or the like from a given location into another location. The requirements thereof result in the course of working such materials in manifold ways. For this purpose, the mandrel of the tilting harness is inserted into the core bore of the roll or the reel and is forced apart therein. By hoisting the crane carriage, the weight is then lifted, and by tilting the rolling frame in the crane carriage into another position, usually the load can be tilted by 90°. By selecting the center of gravity of the load with the help of the rolling frame, the tilting harness is comparatively easy to handle.

The arrangements for clamping the mandrel with respect to the core bore of the roll or spool are usually rather complicated and expensive. Furthermore, they sometimes also require much space. Generally these clamping mandrels function purely mechanically, and engage predominantly on the external part of the roll. However, increasingly such rolls are produced only with cylinder bores without external coils, thus making it more difficult to use harnesses designed in this way.

For clamping jaws of the mandrel which can be forced apart and which engage in the cylinder bore, in particular, there have already been proposed hydraulic devices together with a set of initially stressed cup springs. Despite their excellent technical operating characteristics, even these devices are in most cases too complicated and too expensive for practical applications.

The object of the invention is to provide a tilting harness of the initially mentioned kind such that not only designwise but also with respect to handling, simple construction and a safe handling of the rolls are assured.

The object of the invention is solved whereby the drive for the operation of the clamping jaw comprises a spring-stressed tilting lever which can be tilted by means of a cam against the spring force in the retracted position of the clamping jaw.

Because of the configuration of the invention, in which preferably there is used only one clamping jaw instead of the usual three clamping jaws offset by 120°, it is possible to entirely eliminate the required hydraulic pistons and their respective control systems necessary for the devices proposed up to now. According to the invention, because of the utilization of a mechanical drive of the clamping jaws, by means of the selection of corresponding lever arms and thus force transmissions, it is possible to attain extraordinarly high clamping forces which always remain constant. Thus, even heavy reels and rolls are safely held on the support mandrel, even if the support mandrel is perpendicularly pointing downward. The high clamping forces, on the other hand, in the configuration according to the invention are opposed only by relatively low forces required for adjusting the cam, because only the cam alone has to overcome the counter-acting spring force. If necessary, even the counter-acting spring force can be further reduced by leverage.

It is within the scope of the invention that the tilting lever is provided with a short lever arm for acting upon the clamping jaw and a long lever arm for the action of the spring force and of the cam. The mandrel engaging into the core bore of the reel or roll has enough room inside the mandrel for such a double lever with a short load arm and a long force arm, so that the transmission of the force can be adjusted within a comparatively wide range to the corresponding requirements.

The short lever arm of the tilting lever especially advantageously engages immediately in a window-like opening of the foot portion of the clamping jaw, so that an automatic guidance is attained between the tilting lever and clamping jaw, i.e., so that the clamping jaw follows each movement of the tilting lever, i.e., during extending the clamping jaw into the clamping position, as well as during retracting the clamping jaw into the disengaged position.

In an especially simple configuration, according to a further characteristic of the invention, the spring comprises a compression spring arranged inside a longitudinally adjustable casing. By means of the longitudinal adjustability of the casing in its support on the rolling frame, or the like, the initial tensioning of the spring arranged in the casing, and thus the force for clamping the clamping jaw in relation to the roll or reel which has to be received by the mandrel, can be varied in a comparatively wide range.

Another alternative is provided in the invention, whereby a spring arrangement intially tensioned in a pressure housing is provided between the cam and the lever arm, and the pressure housing acts upon the lever arm and can be slidably guided without pressure in a transverse direction in relation to the lever arm. The spring arrangement can comprise one or a multitude of spiral springs, if necessary, also cup springs or the like. These springs are supported enclosed in the pressure housing under intitial tensioning. Also in this case, if necessary, a device for changing the initial tensioning of the springs can be provided. The slidable support of the pressure housing on the rolling frame has the effect that the pressure housing with the therein provided initially tensioned spring arrangement follows the movements of the long lever arm, whereby the movements are caused by the cam. This movement of the force arm ends with the frictional contact of the clamping jaw on the inside of the spool or roll. The clamping jaw is activated by the short lever arm. By means of the spring arrangement interconnected between the cams and the lever arm, further movement of the cams is received by the pressure springs, whereas the tilting arm does not move any further. The advantage of this configuration consists in that a large portion of the entire clamping movement caused by operating the cam takes place without pressure and only the last portion of the movement process takes place against the force of the pressure springs of the spring arrangement. This considerably facilitates the operation of the apparatus, whereas on the other hand, the available clamping force is at disposal unchanged. In a further configuration according to the invention, the mechanical connection between cam and spring arrangement is such that between the cam and the spring arrangement, there is provided a yoke which is slidable in relation to the pressure housing, and of which one of its thrust pieces is arranged on the cam and its other thrust piece is arranged inside the pressure housing as a counter support for the pressure spring, whereby the pressure housing forms the other counter support for the pressure spring arrangement. By means of the force of the pressure spring arrangement, one of the thrust pieces of this yoke is usually held in firm contact with the pressure housing. To a certain extent, the pressure housing and the slidable yoke form an unchangeable unit, as long as the long lever arm of the tilting lever follows the movement of the cam. This unit formed by the yoke and pressure housing is only then canceled, when the clamping jaw comes into firm contact with the load to be received by the mandrel, and from this results a relative movement of the yoke in relation to the pressure housing, and this relative movement is counter-acted by one or a plurality of pressure springs of the pressure spring arrangement within the pressure housing.

It is in the scope of the invention to provide a roll guide for the pressure housing on the rolling frame. On the other hand, a further characteristic of the invention provides that the pressure housing is provided with an automatic guide for the lever arm. For instance, at a frame portion, the pressure housing can thus be provided with a window, into which extends the end of the tilting lever. If necessary, the tilting lever can also extend between two pins supported at a distance on the pressure housing. In this way there results an automatic guide between the pressure housing and lever arm, whereby the pressure housing follows all of the movements of the long lever arm of the tilting lever, whereby the movements are caused by the cam.

In order to prevent under any circumstances the danger that the roll or reel received on the mandrel falls off due to erroneous handling when the clamping jaws either are not forced apart, or are not sufficiently forced apart, and thus reliably exclude accident proneness, in a further configuration of the invention, there is provided a locking device for the tilting lever. The locking device is automatically activated in the extended position of the clamping jaw. This locking does not necessarily have to engage immediately at the tilting lever, it can also act in the same way upon the cam or upon a portion which is fixedly connected therewith. This locking device can be especially advantageously configured in such a way that a slidable stop pin is provided which is under the effect of a clamping spring and which can be slid in a transverse direction to the tilting lever or to the cam or a component connected therewith, whereby the slidable stop pin engages in one of the end positions of the cam corresponding to the extended position of the clamping jaw, into a corresponding opening on the cam or on the tilting lever or the like. A locking device of such construction safeguards that the tilting lever can only be operated for tilting the rolling frame when the clamping jaws are forced apart.

According to the invention there is provided another alternative, whereby the cam can be connected to a locking plate provided with a notch, the locking plate being arranged in the path of motion of a locking bar, which is under spring tension in the direction of engagement with respect to the notch. When the clamping jaw is operated and the cam has reached its end position, then under the force exerted by the spring acting upon the locking bar, the locking bar falls into the notch and brings the apparatus to a reliable stop.

Finally, it is within the scope of the invention to provide further circumfertial offset friction linings on the mandrel at the opposite side of the clamping jaws in order to assure safe clamping of the mandrel in the cylinder bore of the roll or reel to be received and to prevent in any case that the load falls off, whether or not only one extendable and retractable clamping jaw is used.

Further advantages, characteristics and features of the invention result from the following description of a few preferred embodiments of the invention and from the drawings.

DESCRIPTION OF THE PREFERRED EMBODIMENTS

Figure 1:
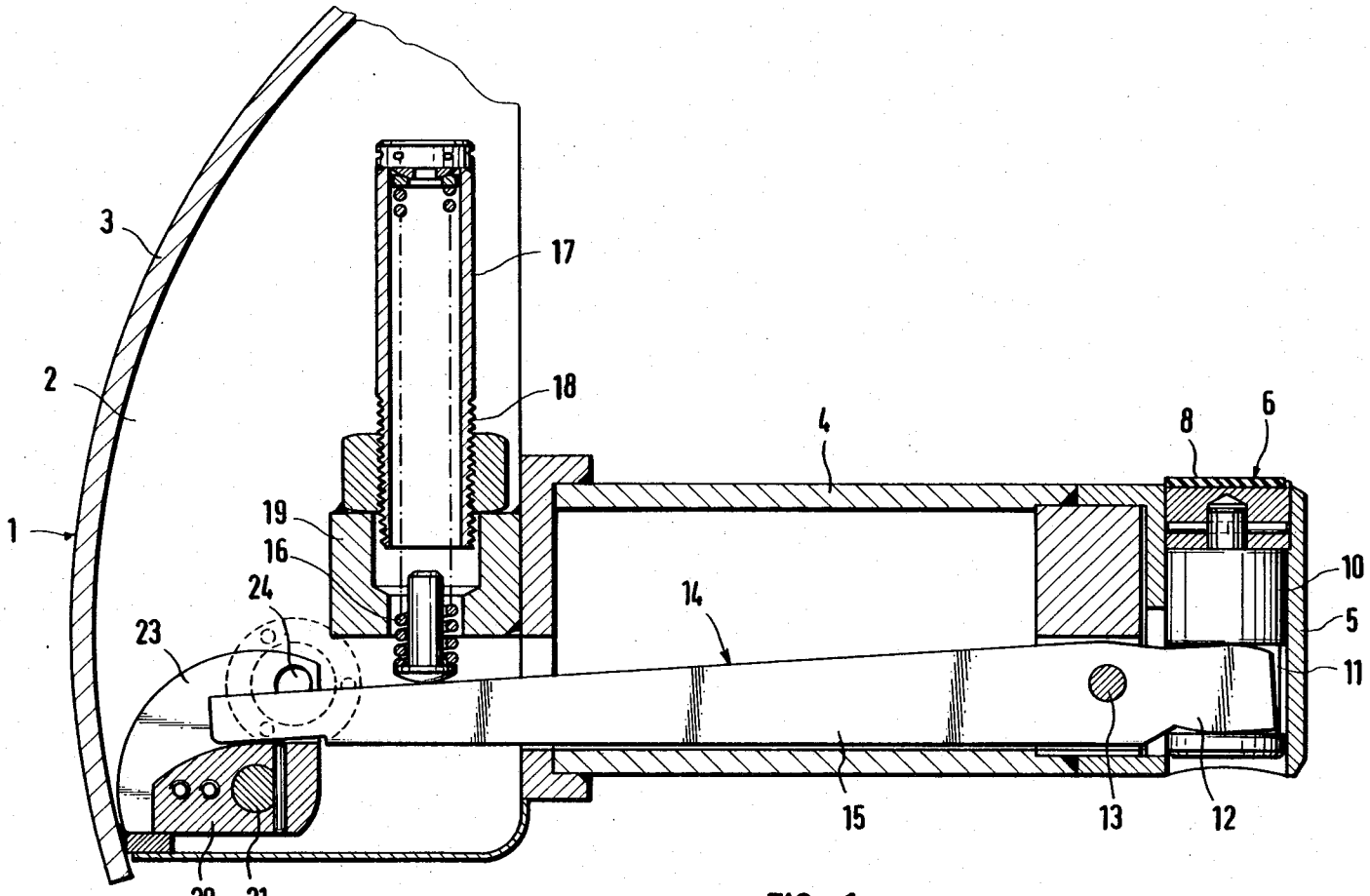
FIG. 1 is an axial cross-sectional view through the mandrel of a tilting harness according to the invention, wherein the rolling frame thereof is indicated in relation to the crane carriage which is broken away but which is configured in the conventional way, and showing the extended position of the clamping jaw.
Figure 2:
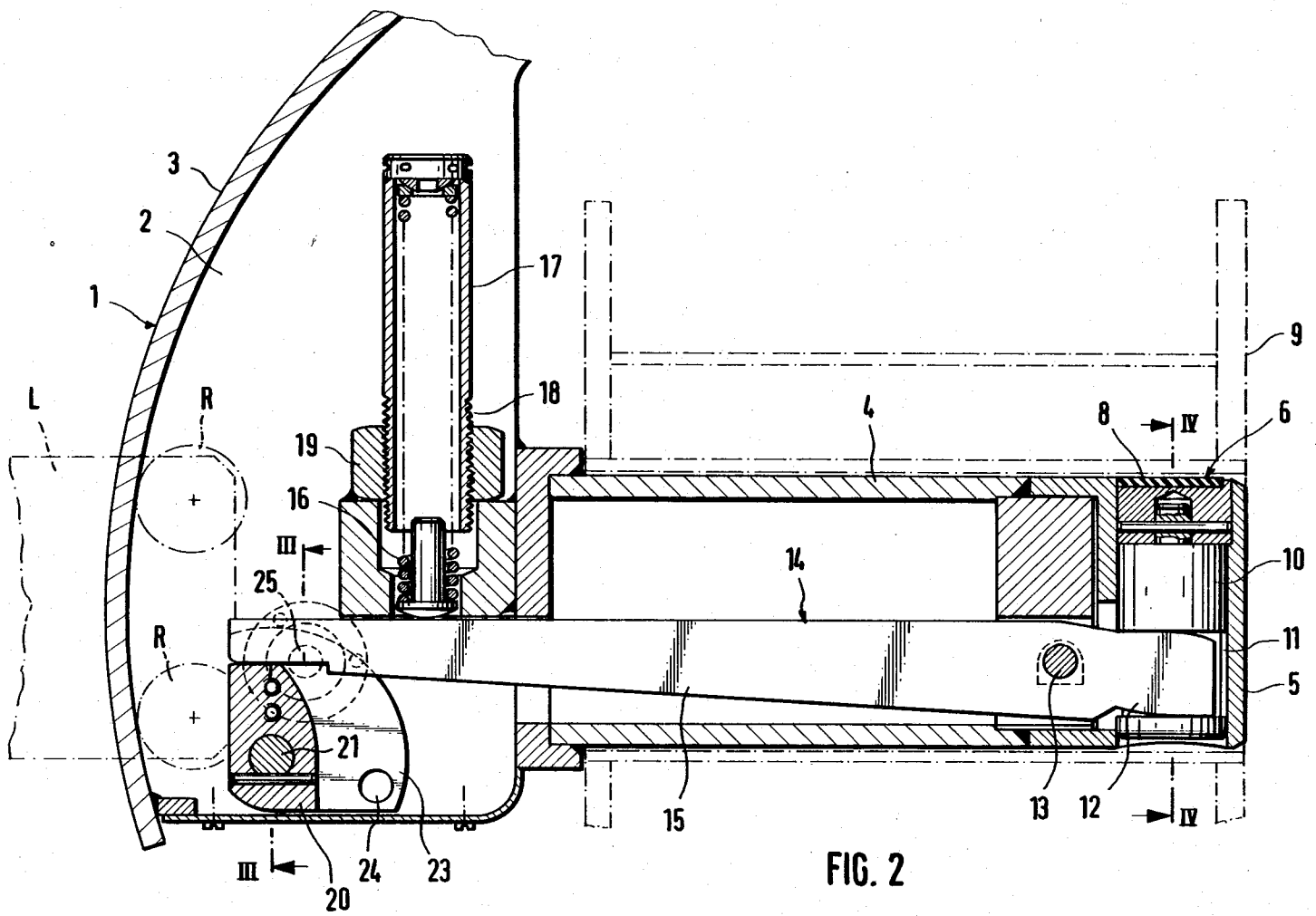
FIG. 2 is a view according to FIG. 1, but showing the clamping jaws retracted.

A rolling frame 1 is shown only in sections in the figures. A flange 2 of the rolling frame 1 is guided in the rolls of the crane carriage L indicated in dotted lines, whereas the rolls R run on the crosspiece 3. A mandrel 4 is fastened at one ends of the rolling frame 1. In the proximity of the frontal side 5 of the mandrel 4, there is provided a radially slidable clamping jaw 6. The clamping jaw 6 is shown in FIG. 1 in its extended position and in FIG. 2 in its retracted position. Frictional linings 7 are superposed in the area of the free end of the mandrel 4, offset by 120° from the clamping jaw 6, in order to attain in connection with the extendable clamping jaw 6, which is also provided with a frictional lining 8, a safe, slide-proof forcing apart action in the roll 9 indicated by dotted lines in FIG. 2.

The foot section 10 of the clamping jaw 6 provided with an opening 11 into which extends the short lever arm 12 of a tilting lever 14 supported immediately in the vicinity the clamping jaw 6 on an axis 13. The longer lever arm 15 of the tilting lever 14 is under the effect of a compression spring 16. The helical compression spring 16 is arranged inside a jacket 17 which is provided with an external thread 18 and can be screwed in or screwed out of the bearing base 19 which, by means of correspondingly shortening the helical compression spring 16, makes possible the adjustment of the initial pre-tensioning of the helical compression spring 16, and thus the spring force, with which the clamping jaw 6 is pushed radially outwardly into its clamping position; the spring force being transmitted by means of the lever relationship of the tilting lever 14.

Figure 3:
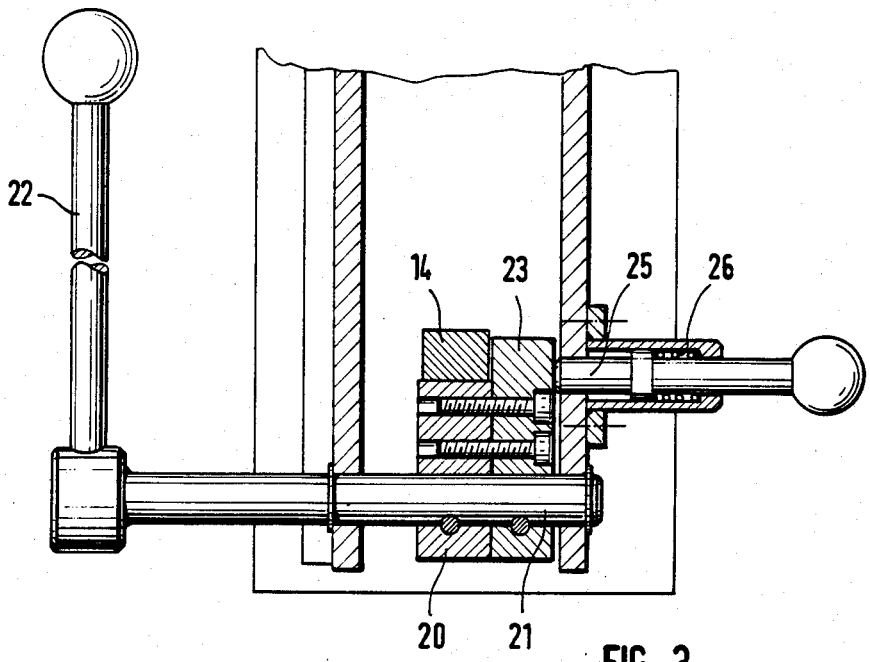
FIG. 3 is a longitudinal view along the offset line III—III in FIG. 2 in the area of the actuating cam.
Figure 4:
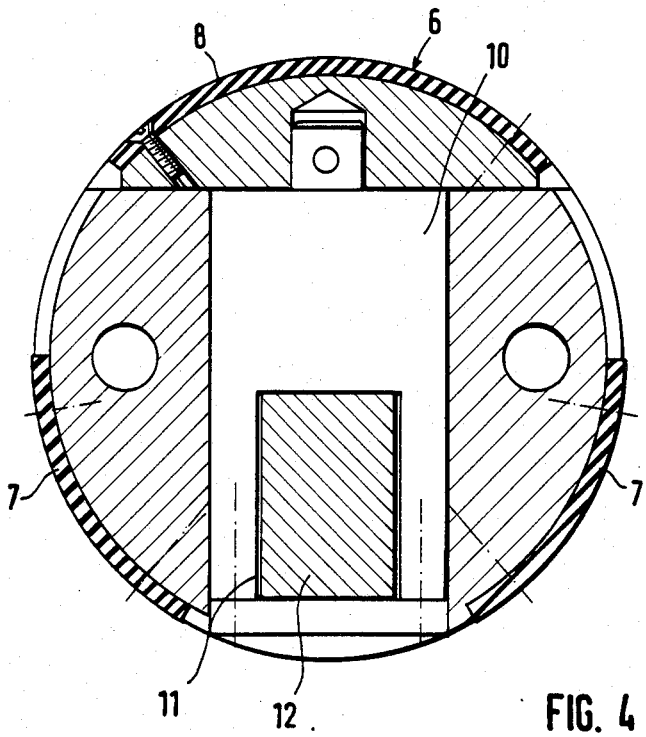
FIG. 4 is an enlarged view through the tip of the mandrel along the line IV—IV in FIG. 2.

In the area of the free end of the lever arm 15 of the tilting lever 14 a cam 20 is fastened on a shaft 21 which is provided with a hand lever 22. The hand lever 22 activates a tilting of the cam 20 from the position shown in FIG. 1 to the position shown in FIG. 2, whereby in FIG. 1 the tilting lever 14 is shifted outwardly into a clamping position under the effect of the compression spring 16, and in FIG. 2, the tilting lever 20 has been shifted by the cam against the force of the helical pressure spring 16, so that the tilting lever 20 has moved back the clamping jaw 6 into the retracted position in the mandrel 4. The cam 20 is fixedly connected to a locking plate 23 provided with a locking opening 24, which, in the tilting position according to FIG. 1, i.e. in the extended clamping position of the clamping jaw 6, is aligned with a spring-stressed locking bolt 25 (FIG. 3), so that this locking bolt automatically engages in the opening 24 and thus prevents the cam 20 from turning back. Consequently, also the clamping jaw 6 cannot be moved back into the retracted position, so that in this locking position of the cam 20, it is not possible to cancel the clamping of the mandrel 4 in the roll 9. This locking furthermore also has the object that because of the concurrently caused locking of the hand lever 22, in order to tilt the rolling frame in the rolls R of the crane carriage L, the hand lever 22 can only be used when the clamping jaw is extended.

Figure 5:
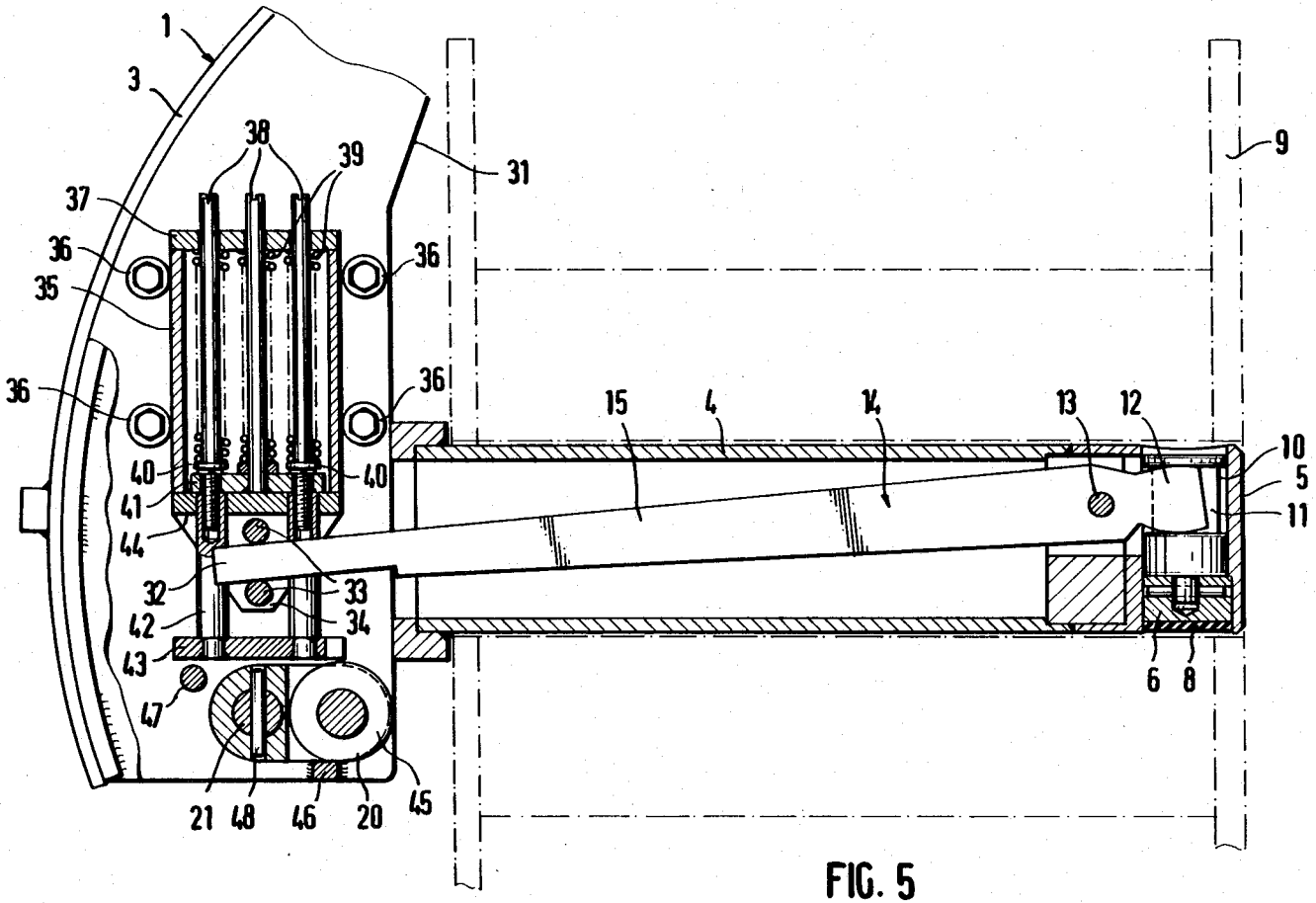
FIG. 5 is a broken away view of a further embodiment of the invention showing the clamping jaws retracted.
Figure 9:
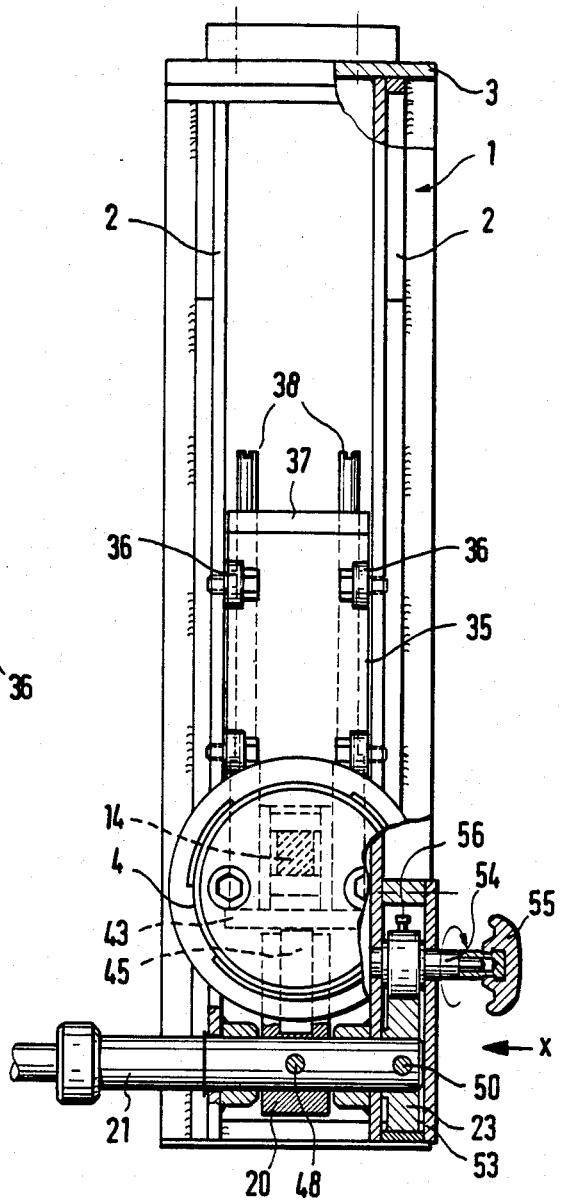
FIG. 9 is a sectional view of FIG. 6 in the direction of the arrow IX.
Figure 10:
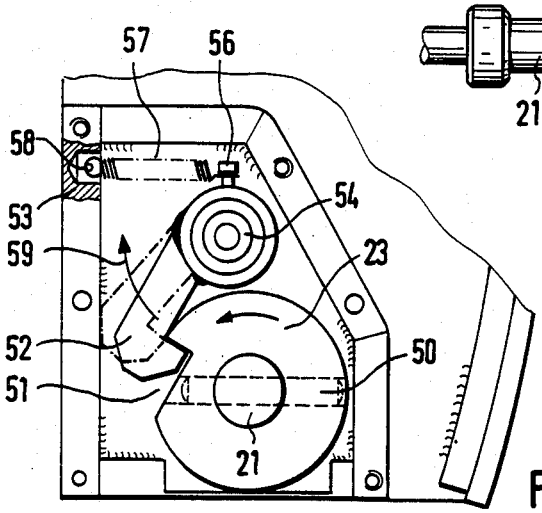
FIG. 10 is a view of FIG. 9 in the direction of the arrow X without the division plate and hand wheel.

FIGS. 5 to 10 illustrate a further embodiment. The crane carriage L is suspended by its hook 30 on a hoisting device, a crane hook or the like, which is not illustrated. The crane carriage L guides on its rollers R the crosspiece 3 of the rolling frame 1 on both sides of the rolling frame flange 2. The mandrel 4 is fastened on the inside 31 of the rolling frame 1, in which the tilting lever 14, which is configured as a double level, is tiltably supported about the axis 13. The short lever arm 12 extends into a window-like opening 11 of the foot 10 of the clamping jaw 6, whereby the friction lining of the clamping jaw 6 is indicated by 8. The end 32 of the long lever arm 15 of the tilting lever 14 extends into the space between the two pins 33 which are arranged on a continuation 34 of the housing of a pressure housing 35. The latter is arranged between the two flanges 2 of the rolling frame 1, as can be seen in FIG. 9. The pressure housing 35 is slidably guided in its longitudinal direction between rollers 36 supported on the flanges 2. In the illustrated embodiment, inside the pressure housing 35, which is closed by a cover 37, there are arranged six spring pins 38 on each of which there is supported pressure spring 39 which is under pre-tension. On one side, the pressure springs 39 are supported on the cover 37 of the housing 35, and on the other side, they are supported via collar 40 on the pressure piece 41 of a yoke 42, whereof the other pressure piece 43 makes contact with the cam 20. The pins 38 supporting the pressure springs 39 are supported on the pressure piece 41. The initial position is shown in FIG. 5. Therein the pressure piece 41 of the yoke 42 makes contact with the inside of the frontal wall 44 of the pressure housing 35. The roller 45 of the cam 20, which can be moved between the two stops 46 and 47, makes contact with the pressure piece 43. The cam 20 is fastened on the shaft 21 by a pin 48.

The locking plate 23 is fastened by a pin 50 at the end of the shaft 21. The locking plate 23 is provided with a notch 51 and is arranged in the area of movement of a locking bar 52, which is fastened on a shaft 54 supported in the housing 53. The shaft 54 has at its end a hand wheel 55. A bolt spring 57 acts upon the mounting 56 of the locking bar 52. The other end of the bolt spring 57 is fastened at 58 to the housing 53. By means of this bolt spring 57 the locking bolt 52 is held engaged with the notch 51 of the locking plate 23 in the opposite direction of the arrow 59. The locking position shown in FIG. 10 corresponds to the extended position of the clamping jaw 6 according to FIGS. 6 and 7. It is recognizable that the hand lever 22 is stopped in this position. With the help of the hand lever 22 it is possible to move the entire rolling frame 1 in the crane carriage L. The additional bolt spring 60 arranged between lever arm 15 and cam 20 has the task of keeping the cam 20 in the position shown in FIG. 6. The bolt spring 60 is attached to a mounting 61 on the cam 20 and an additional mounting 62 on the tilting lever 14.

When the stop of the locking plate 23 is canceled in that the locking bar 52 is lifted out of the notch 51 of the locking plate 23 by operating the hand wheel 55, then the cam 20 can be tilted back in the position according to FIG. 5. Thereby, there occurs the relaxation of the pressure springs 39 until the pressure plate 41 of the yoke makes contact on the inside of the housing wall 44. Simultaneously, the long lever arm 15 of the tilting lever 14 is pivoted back to the initial position shown in FIG. 5 by means of the automatic guidance between the two pins 33 of the pressure housing 35, whereby the clamping jaw 6 is retracted as shown.

Figure 6:
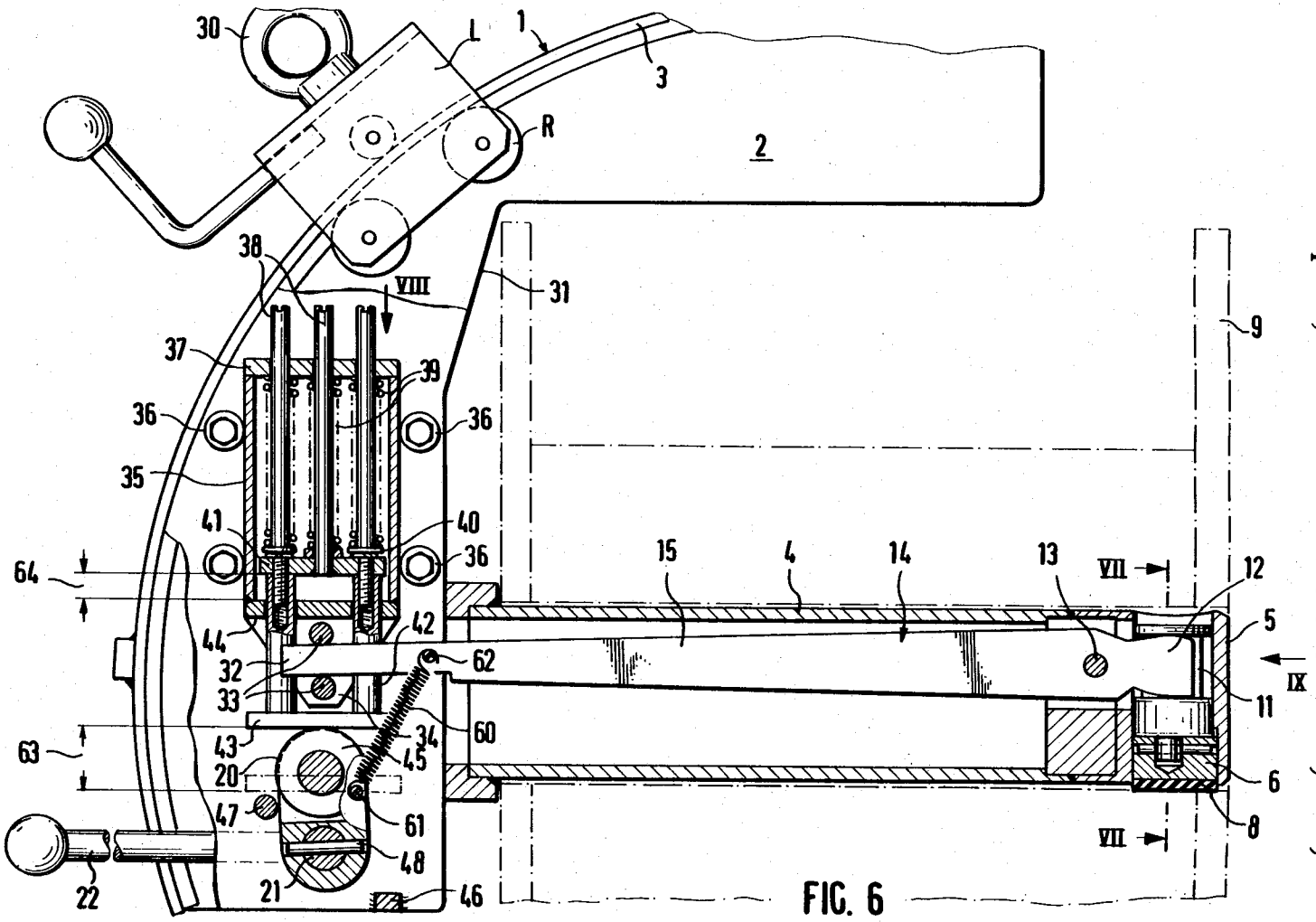
FIG. 6 shows the apparatus according to FIG. 5 with the clamping jaws extended.
Figure 7:
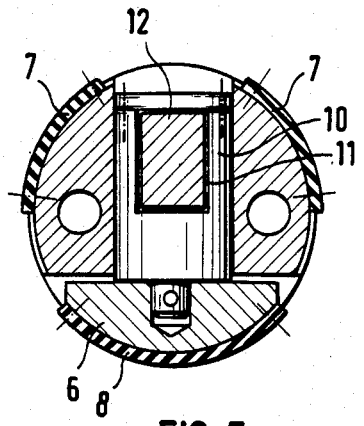
FIG. 7 is a view taken approximately along line VII—VII in FIG. 6.
Figure 8:
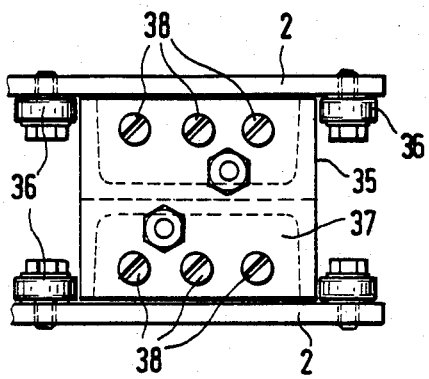
FIG. 8 is a top view in the direction of the arrow VIII in FIG. 6.

The entire trajectory of the cam 20 from the position according to FIG. 5 to the position according to FIG. 6 is indicated by 63. Only a short distance thereof, which is indicated in FIG. 6 by 64, is traveled against the force exerted by the pressure springs 39.

I claim:

1. Tilting apparatus for receiving and handling heavy spools or rolls having a core opening comprising a rolling frame means, a mandrel means on which said core opening is received, said mandrel means being mounted on said frame means, said mandrel means having a clamping jaw means which is radially movable between an extended and a retracted position, said jaw means engaging and clamping said core opening when in said extended position, jaw actuating means for actuating and moving said jaw means between said extended and retracted position, said actuating means comprising a pivotal lever pivotably mounted on said mandrel means, said actuating means further comprising spring means for applying a biasing force to said pivotal lever to urge said pivotal lever to an actuated pivotal position in which said lever moves said jaw means to said extended position, and cam means operable to terminate said application of said biasing force to said lever to permit said lever to be pivoted to a deactuated pivotal position in which said jaw means is in said retracted position.

2. Tilting apparatus according to claim 1 further comprising pivotal support means pivotably supporting said lever on said mandrel means at a position to define a first lever arm juxtaposed to said jaw means and a second lever arm juxtaposed to said spring means, said second lever arm being longer than said first lever arm.

3. Tilting apparatus according to claim 2, wherein said second lever arm is several times longer than said first lever arm.

4. Tilting apparatus according to claim 2, wherein said cam means is spaced from said pivotal support means substantially the same distance that said spring means is spaced from said pivotal support means.

5. Tilting apparatus according to claim 2, wherein said jaw means comprises a radially movable jaw member, said jaw nember having a foot portion with an opening, said first lever arm extending into said opening.

6. Tilting apparatus according to claim 1, wherein said spring means comprises a casing and a spring element in said casing, and adjustment means for adjusting the biasing force of said spring element.

7. Tilting apparatus according to claim 1, wherein said spring means comprises a spring housing means in which spring elements are disposed, said spring elements being pre-tensioned in said spring housing means, said spring housing means having engagement means engageable with said lever and transversely slidable relative to said lever.

8. Tilting apparatus according to claim 7, wherein said spring housing means comprises a housing part and a yoke part, said housing part being slidably mounted on said frame means, said yoke part being slidable relative to said housing part, said engagement means being on said housing part, said yoke part being engageable by said cam means to initially move said yoke part and said housing part together as a unit as said lever is initially pivoted from said retracted position and to subsequently move said yoke part relative to said housing part to thereby further comprises said spring elements so that the latter applies said biasing force to said lever to urge said lever to said actuated pivotal position in which said lever moves said jaw means to said extended position.

9. Tilting apparatus according to claim 8 further comprising roller guide means on said frame means for slidably supporting said housing part.

10. Tilting apparatus according to claim 8, wherein said engagement means comprises engagement elements disposed on opposite sides of said lever such that said housing part and said lever move together when said lever pivots in either pivotal direction.

11. Tilting apparatus according to claim 8, wherein said housing part has a first and second wall spaced from each other, said yoke part having a first section slidable within said housing part, said spring elements being pre-tensioned between said first wall of said housing part and said first section of said yoke part, said yoke part having a second section which is engageable by said cam means, said yoke part having a third section connecting said first and second sections.

12. Tilting apparatus according to claim 11, wherein said second wall of said housing part has openings, said third section of said yoke part being slidably disposed in said openings.

13. Tilting apparatus according to claim 11, wherein said first and second yoke sections are disposed on one side of said lever, said third section of said lever being disposed on the opposite side of said lever.

14. Tilting apparatus according to claim 11, wherein the amount of slidable movement of said yoke part relative to said housing part is less than the amount of the slidable movement of said yoke part relative to said frame means when said lever is pivoted between said actuated and deactuated positions.

15. Tilting apparatus according to claim 1 further comprising a locking means for locking said jaw means in said extended position.

16. Tilting apparatus according to claim 15, wherein said cam means has an opening, said locking means engaging said opening when said jaw means is in said extended position.

17. Tilting apparatus according to claim 15, wherein said lever has an opening, said locking means being received in said opening when said jaw means is in said extended position.

18. Tilting apparatus according to claim 15 further comprising a spring urging said locking means in a locking position.

19. Tilting apparatus according to claim 15, wherein said cam means comprises a cam element and a locking plate mounted on the cam element, said locking plate having a notch, said locking means further comprising a locking latch element which is engageable in said notch, and a spring element urging said latch element into engagement with said notch.

20. Tilting apparatus according to claim 1, wherein said mandrel means has a generally cylindrical configuration, said mandrel means having an axis extending laterally from said frame means.

21. Tilting apparatus according to claim 1, wherein said frame means is adapted to be carried by a crane and is operable to tilt said mandrel means over at least a ninety degree angle.

22. Tilting apparatus according to claim 1 further comprising a brake lining disposed on said jaw means.

23. Tilting apparatus according to claim 22 further comprising brake linings circumferentially spaced on said mandrel.

* * * * *